US012280856B2

(12) United States Patent
Schultz et al.

(10) Patent No.: US 12,280,856 B2
(45) Date of Patent: Apr. 22, 2025

(54) WAKEBOARD TOWER ASSEMBLY

(71) Applicant: Geremarie Corporation, Lake Zurich, IL (US)

(72) Inventors: Jim Schultz, South Barrington, IL (US); Greg Mackall, Volo, IL (US); Doug Erdman, McHenry, IL (US)

(73) Assignee: Geremarie Corporation, Lake Zurich, IL (US)

( * ) Notice: Subject to any disclaimer, the term of this patent is extended or adjusted under 35 U.S.C. 154(b) by 530 days.

(21) Appl. No.: 17/663,092

(22) Filed: May 12, 2022

(65) Prior Publication Data

US 2022/0371693 A1 Nov. 24, 2022

Related U.S. Application Data

(60) Provisional application No. 63/191,626, filed on May 21, 2021.

(51) Int. Cl.
*B63B 21/56* (2006.01)

(52) U.S. Cl.
CPC ..... *B63B 21/56* (2013.01); *B63B 2021/566* (2013.01)

(58) Field of Classification Search
CPC ..... B63B 21/56; B63B 2021/566
See application file for complete search history.

(56) References Cited

U.S. PATENT DOCUMENTS

2007/0283873 A1* 12/2007 Jackson ..... F16M 13/02 114/343

FOREIGN PATENT DOCUMENTS

JP 2011088524 A * 5/2011 ..... B63B 35/731

* cited by examiner

*Primary Examiner* — S. Joseph Morano
*Assistant Examiner* — Jovon E Hayes
(74) *Attorney, Agent, or Firm* — Price Heneveld LLP

(57) ABSTRACT

A wakeboard tower assembly includes a base assembly operably supporting a towing assembly between a lowered storage position and a raised in-use position, and a cylinder assembly configured to bias the towing assembly from the lowered storage position toward the raised in-use position, a closed loop fluid circuit that includes a fluid-receiving first chamber including first and second portions and a return passage, and a gas-receiving second chamber including first and second portions in fluid connection with one another, a shaft telescopingly received within the cylinder between retracted and extended positions, and a controllable valve operable between closed and open positions that prevents or allows fluid flow through the return passage and fluid communication between the first and second chambers of the first chamber thereby preventing or allowing the towing assembly from moving between the lowered storage and raised in-use positions.

29 Claims, 7 Drawing Sheets

WAKEBOARD TOWER ASSEMBLY

CROSS-REFERENCE TO RELATED APPLICATIONS

This application claims benefit of U.S. Provisional Patent Application No. 63/191,626, filed on May 21, 2021, entitled "WAKEBOARD TOWER ASSEMBLY," the entire disclosure of which is incorporated herein by reference.

BACKGROUND OF THE INVENTION

The embodiments as disclosed herein relate to a wakeboard tower assembly, and in particular to a wakeboard tower assembly movable between a lowered storage position and a raised in-use position.

SUMMARY OF THE INVENTION

One aspect of the embodiments disclosed herein includes a wakeboard tower assembly that includes a towing assembly configured to support a tow rope, a base assembly operably supporting the towing assembly between a lowered storage position and a raised in-use position, and at least one cylinder assembly configured to bias the towing assembly from the lowered storage position toward the raised in-use position. The at least one cylinder assembly may include a cylinder including a first chamber configured to receive a fluid and a second chamber separated from the first chamber and configured to receive a pressurized gas, a shaft telescopingly received within the cylinder between a retracted position corresponding to the lowered storage position of the towing assembly and an extended position corresponding to the raised in-use position of the towing assembly, and a first piston fixed to the shaft and configured to cooperate with the cylinder to divide the first chamber into a first portion of the first chamber and a second portion of the first chamber. The at least one cylinder assembly may further include a second piston fixed to the shaft and configured to cooperate with the cylinder to divide the second chamber into a first portion of the second chamber and a second portion of the second chamber, wherein the second piston includes a port providing fluid communication between the first and second portions of the second chamber, and wherein the pressurized gas biases the shaft from the retracted position toward the extended position, a return passage configured to provide fluid communication between the first and second portion of the first chamber, wherein the first chamber and the return passage cooperate to form a closed loop. The at least one cylinder assembly may still further include a controllable valve operable between a closed position that prevents fluid flow through the return passage and fluid communication between the first and second chambers of the first chamber thereby preventing the shaft from moving between the retracted and extended positions and the towing assembly from moving between the lowered storage and raised in-use positions, and an open position that allows fluid flow through the return passage and fluid communication between the first and second portions of the first chamber thereby allowing the shaft to move between the retracted and extended positions and the towing assembly to move between the lowered storage and raised in-use positions.

Another aspect of the embodiments disclosed herein may further or alternatively include a wakeboard tower assembly that includes a towing assembly including a pair of vertically extending arms and a cross member extending horizontally between the pair of arms and configured to support a tow rope, a base assembly pivotably supporting the towing assembly between a lowered storage position and a raised in-use position, and a pair of cylinder assemblies each configured to bias the towing assembly from the lowered storage position toward the raised in-use position. Each cylinder assembly may include a cylinder including a first chamber configured to receive a fluid and a second chamber separated from the first chamber and configured to receive a pressurized gas, a shaft telescopingly received within the cylinder between a retracted position corresponding to the lowered storage position of the towing assembly and an extended position corresponding to the raised in-use position of the towing assembly, a first piston fixed to the shaft and configured to cooperate with the cylinder to divide the first chamber into a first portion of the first chamber and a second portion of the first chamber, and a second piston fixed to the shaft and configured to cooperate with the cylinder to divide the second chamber into a first portion of the second chamber and a second portion of the second chamber, wherein the second piston includes a port providing fluid communication between the first and second portions of the second chamber, and wherein the pressurized gas biases the shaft from the retracted position toward the extended position. Each cylinder assembly may further include a return passage configured to provide fluid communication between the first and second portion of the first chamber, wherein the first chamber and the return passage cooperate to form a closed loop, and a solenoid valve operable between a closed position that prevents fluid flow through the return passage and fluid communication between the first and second chambers of the first chamber thereby preventing the shaft from moving between the retracted and extended positions and the towing assembly from moving between the lowered storage and raised in-use positions, and an open position that allows fluid flow through the return passage and fluid communication between the first and second portions of the first chamber thereby allowing the shaft to move between the retracted and extended positions and the towing assembly to move between the lowered storage and raised in-use positions.

Yet another aspect of the embodiments disclosed herein may further or alternatively include a method of operating a wakeboard tower assembly that includes providing a towing assembly configured to support a tow rope, providing a base assembly operably supporting the towing assembly between a lowered storage position and a raised in-use position, and providing at least one cylinder assembly configured to bias the towing assembly from the lowered storage position toward the raised in-use position. The at least one cylinder assembly may include a cylinder including a first chamber configured to receive a fluid and a second chamber separated from the first chamber and configured to receive a pressurized gas, a shaft telescopingly received within the cylinder between a retracted position corresponding to the lowered storage position of the towing assembly and an extended position corresponding to the raised in-use position of the towing assembly, a first piston fixed to the shaft and configured to cooperate with the cylinder to divide the first chamber into a first portion of the first chamber and a second portion of the first chamber, and a second piston fixed to the shaft and configured to cooperate with the cylinder to divide the second chamber into a first portion of the second chamber and a second portion of the second chamber, wherein the second piston includes a port providing fluid communication between the first and second portions of the second chamber, and wherein the pressurized gas biases the shaft from the retracted position toward the extended position. The at least one cylinder may further include a return passage configured to provide fluid communication between the first and second portion of the first chamber, wherein the first chamber and the return passage cooperate to form a closed loop, and a controllable valve operable between a closed position that prevents fluid flow through the return passage and fluid communication between the first and second chambers of the first chamber thereby preventing the shaft from moving between the retracted and extended positions and the towing assembly from moving between the lowered storage and raised in-use positions, and an open position that allows fluid flow through the return passage and fluid communication between the first and second portions of the first chamber thereby allowing the shaft to move between the retracted and extended positions and the towing assembly to move between the lowered storage and raised in-use positions. The method may further include repositioning the towing assembly from the lowered storage position to the raised in-use position by operating the controllable valve from the closed to the open, applying a upwardly directed force to towing assembly, moving the towing assembly from the lowered storage position to the raised in-use position, and operating the controllable valve from the open position to the closed position.

These and other features, advantages, and objects of the present invention will be further understood and appreciated by those skilled in the art by reference to the following specification, claims, and appended drawings.

BRIEF DESCRIPTION OF THE DRAWINGS

FIG. 9;

DETAILED DESCRIPTION

Figure 2:
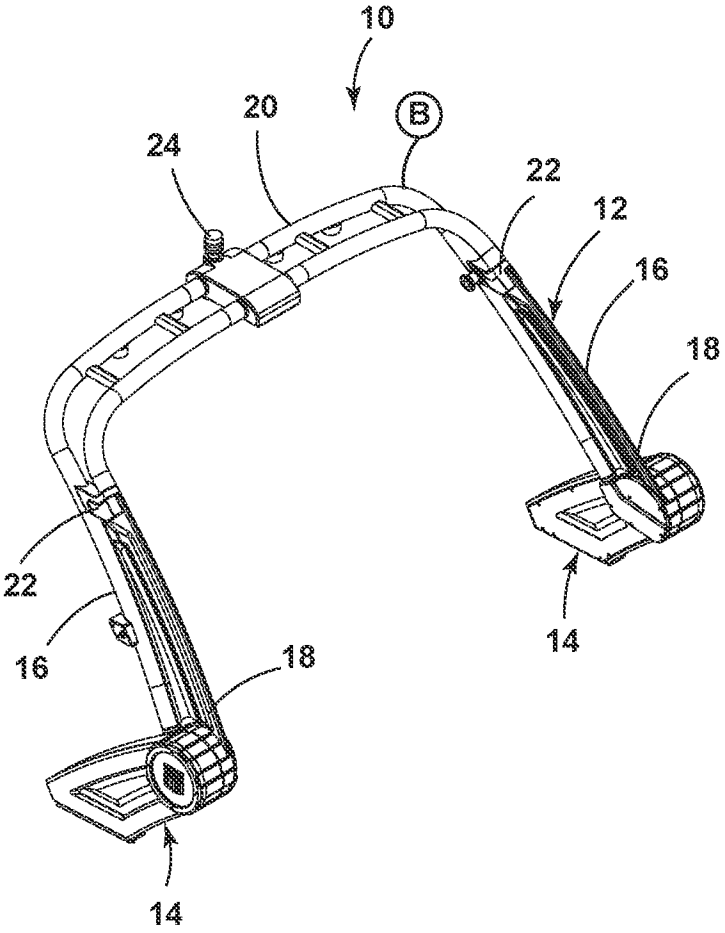
FIG. 2 is a perspective view of the wakeboard tower assembly in a raised in-use position.
Figure 1:
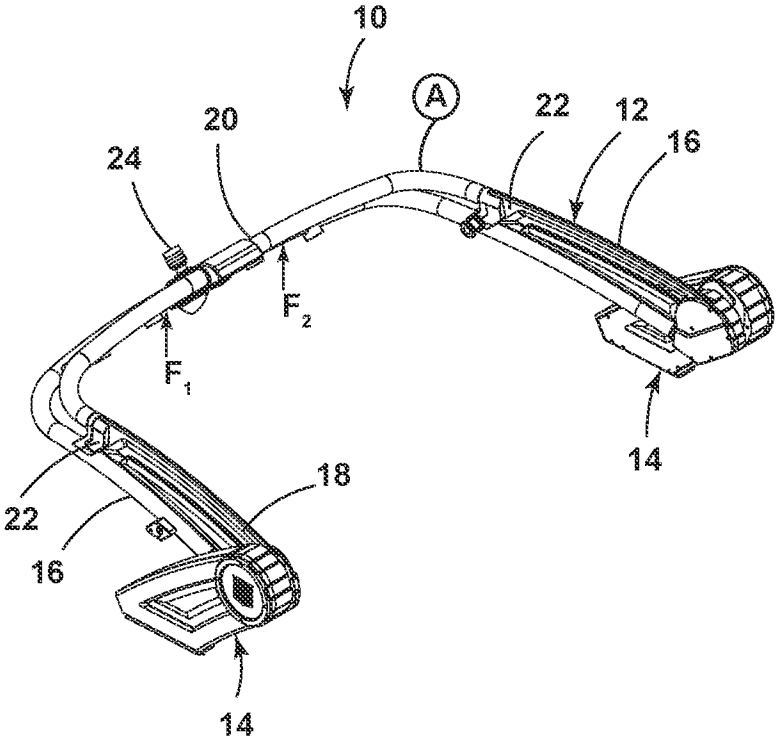
FIG. 1 is a perspective view of a wakeboard tower assembly in a lowered storage position.
Figure 4:
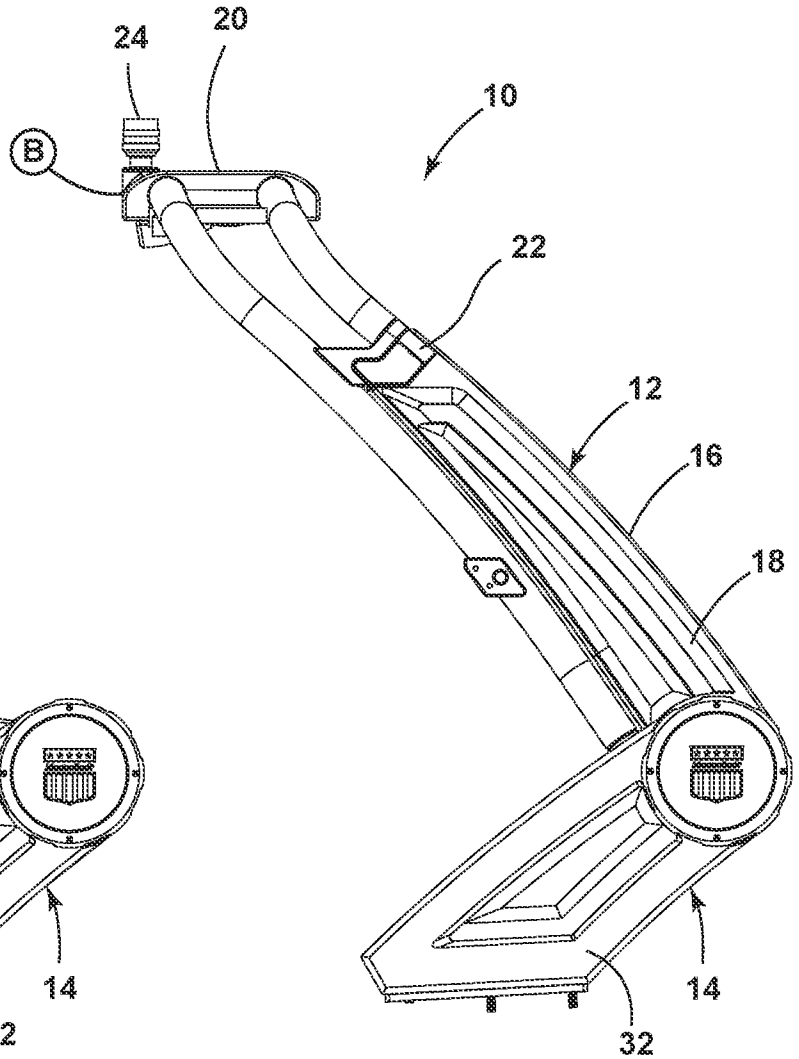
FIG. 4 is a side elevational view of the wakeboard tower assembly in the raised in-use position.
Figure 3:
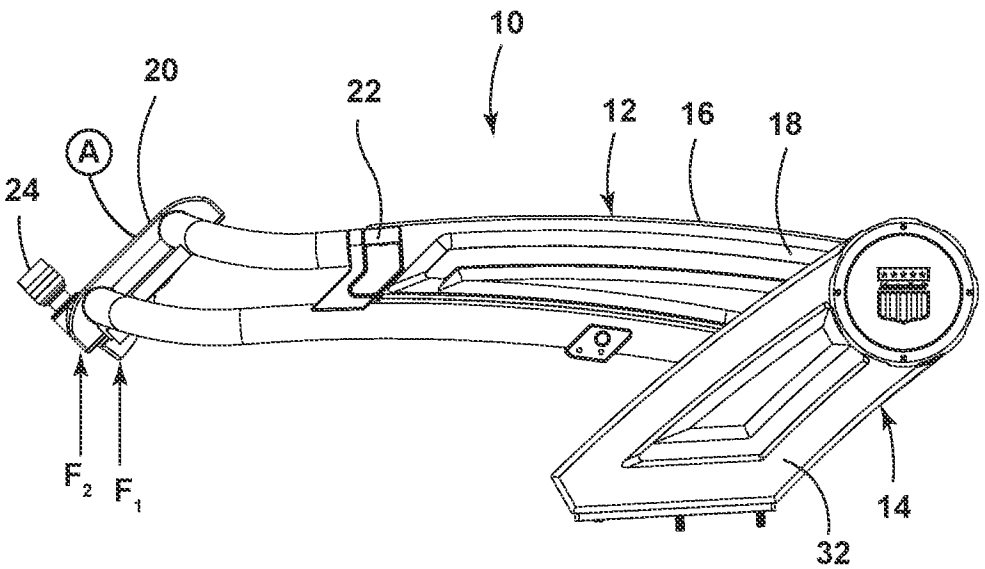
FIG. 3 is a side elevational view of the wakeboard tower assembly in the lowered storage position.

For purposes of description herein, the terms "upper," "lower," "right," "left," "rear," "front," "vertical," "horizontal," and derivatives thereof shall relate to the invention as oriented in FIGS. 1 and 2. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other characteristics relating to the embodiments disclosed herein are not to be considered as limiting, unless the claims expressly state otherwise.

The reference numeral 10 (FIGS. 1 and 2) generally designates an embodiment of a wakeboard tower assembly, with FIG. 1 illustrating the wakeboard tower assembly 10 in a lowered storage position A, and FIG. 2 illustrating the wakeboard tower assembly 10 in a raised in-use position B. In the illustrated example, the wakeboard tower assembly 10 (FIGS. 1-6) includes a towing assembly 12 pivotably supported by a base assembly 14 between the lowered position A and the raised position B, where the base assembly 14 is configured to be supported by a watercraft, such as a ski or wakeboarding boat. The towing assembly 12 may include a pair of arms 16 each having a first end 18 pivotably coupled to the base assembly 14, and a cross member 20 extending horizontally between a second end 22 of each of the arms 16, where the cross member 20 includes an attachment member 24 configured to secure a skiing or wakeboarding tow rope to the overall wakeboard tower assembly 10 to tow a skier or wakeboarder behind the associated watercraft.

The base assembly 14 includes a housing 26 having a mounting portion 28 configured to be mounted to the watercraft via a plurality of mechanical fasteners such as bolts 30, and at least one plate or side panel 32 removably secured to the housing 26 and cooperating therewith to define an interior space 34. The second end 18 of each arm 16 is pivotably coupled to the housing 26 for pivoting movement about a pivot axis 36 between the lowered and raised positions A, B.

Figure 6:
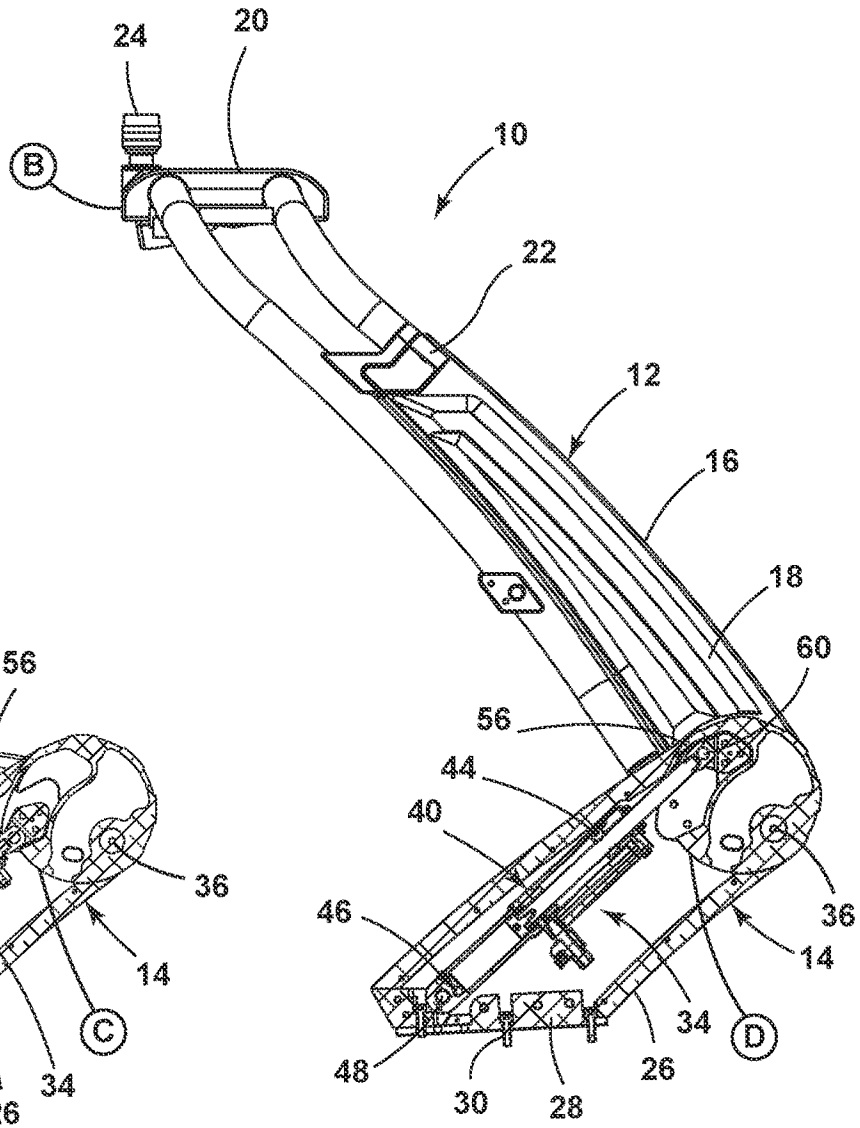
FIG. 6 is a side elevational view of the wakeboard tower assembly in the raised in-use position with the side panel of the base assembly removed to illustrate the cylinder assembly.
Figure 5:
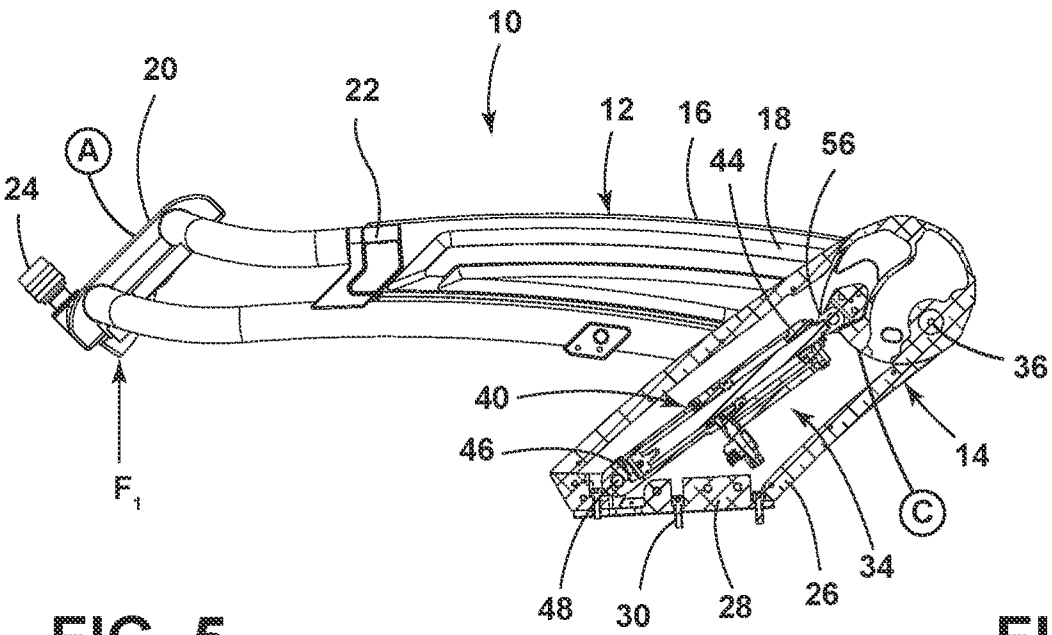
FIG. 5 is a side elevational view of the wakeboard tower assembly in the lowered storage position with an outer panel of a base assembly removed to illustrate a cylinder assembly.
Figure 7:
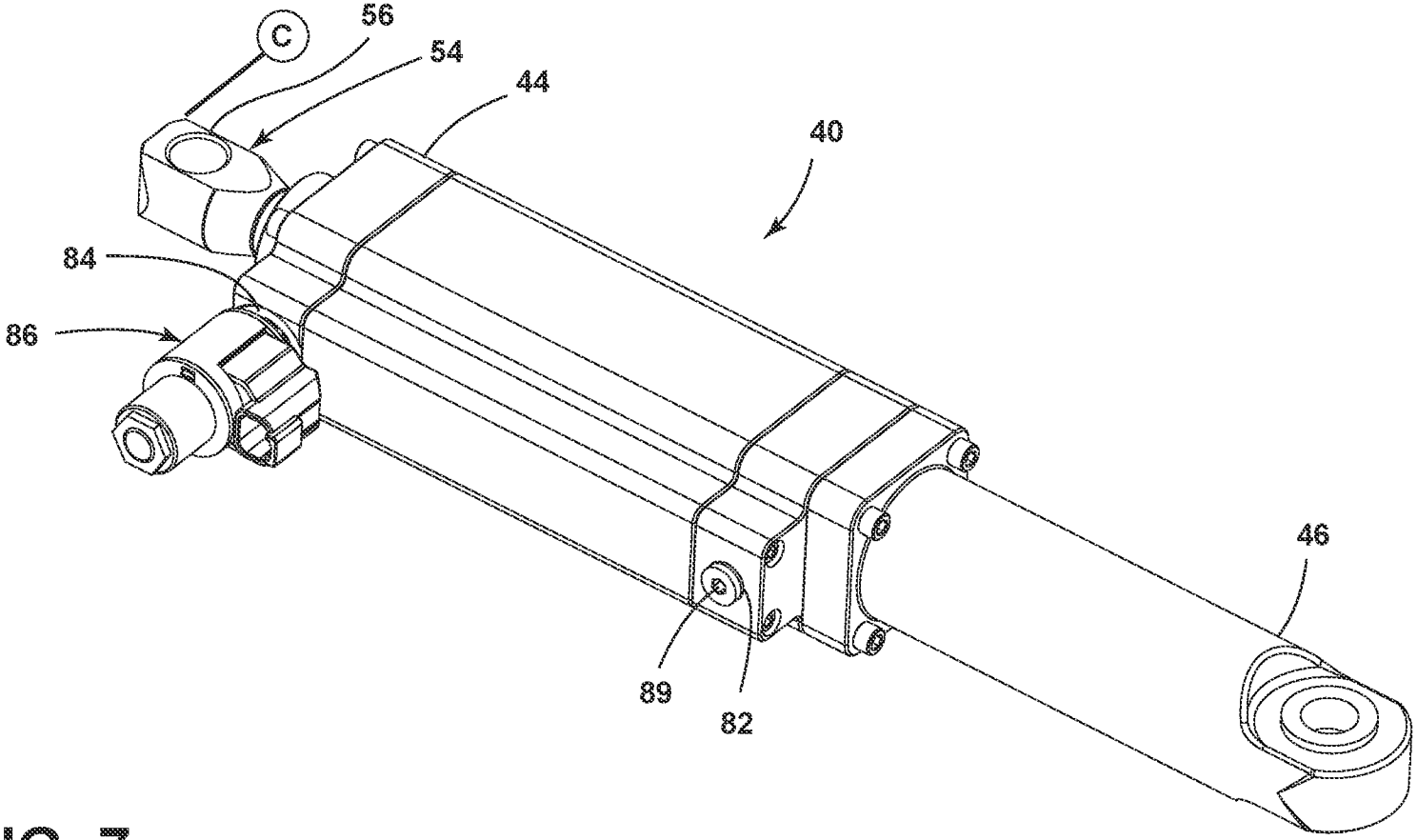
FIG. 7 is a perspective view of the cylinder assembly in a retracted position.
Figure 8:
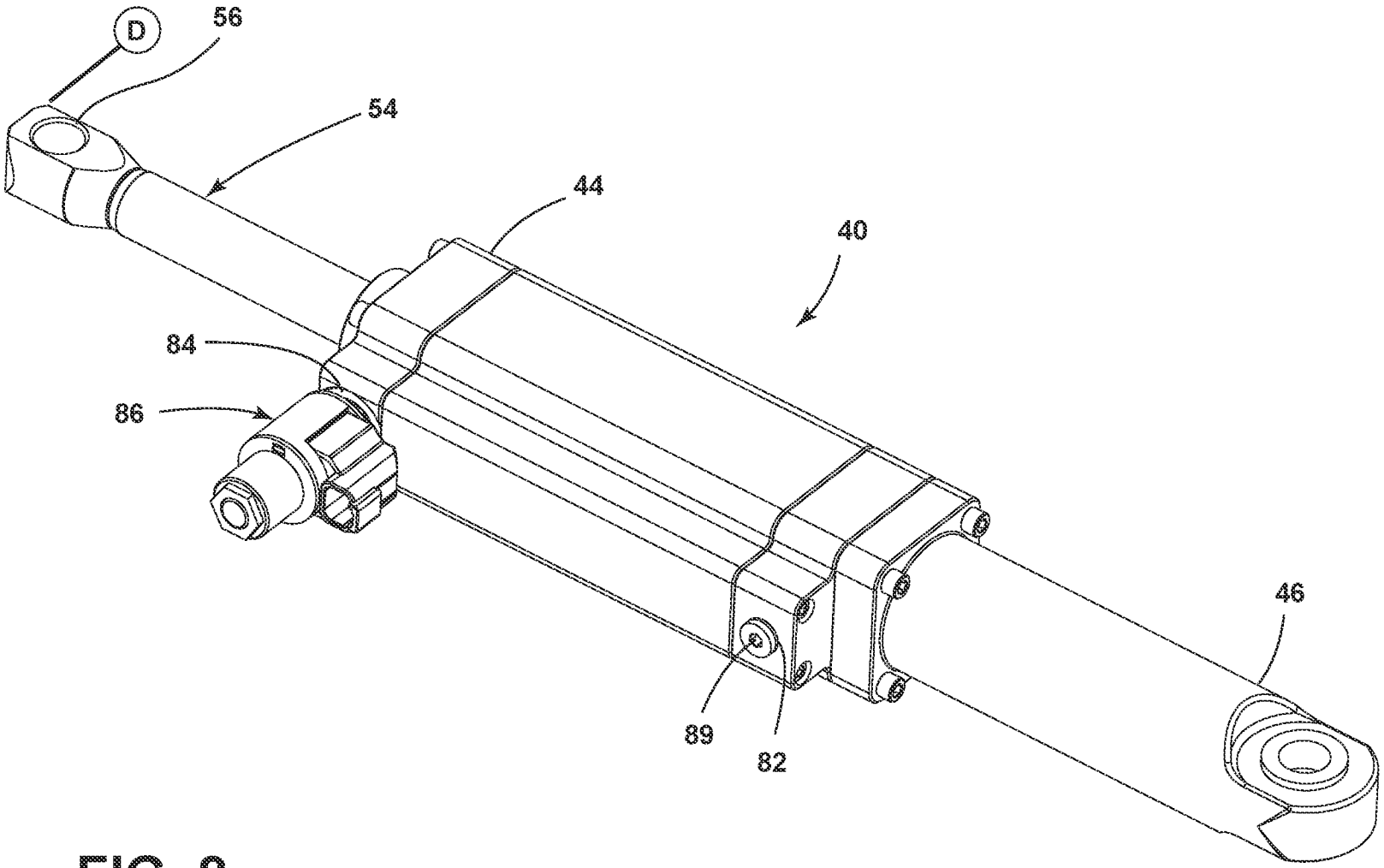
FIG. 8 is a perspective view of the cylinder assembly in an extended position.
Figure 9:
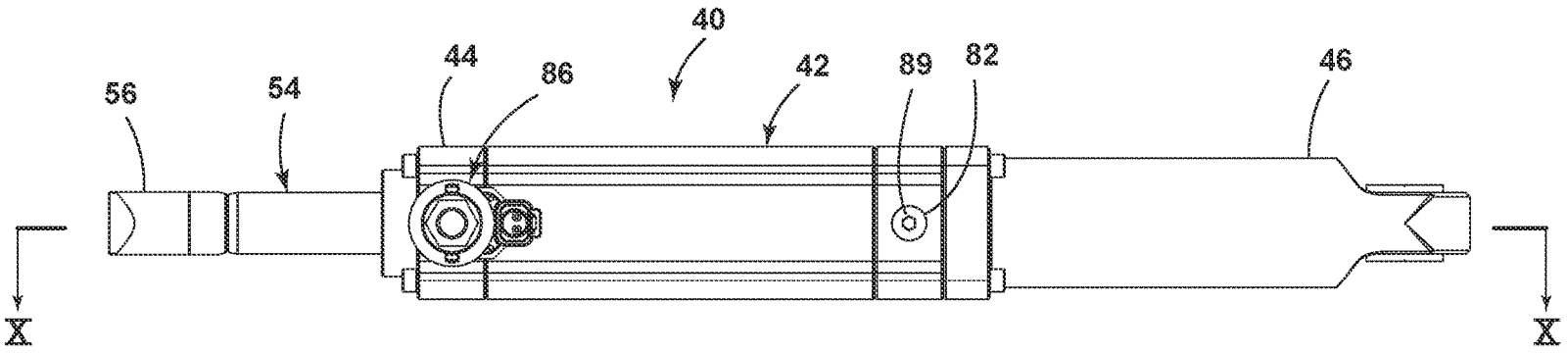
FIG. 9 is a bottom elevational view of the cylinder assembly.
Figure 10:
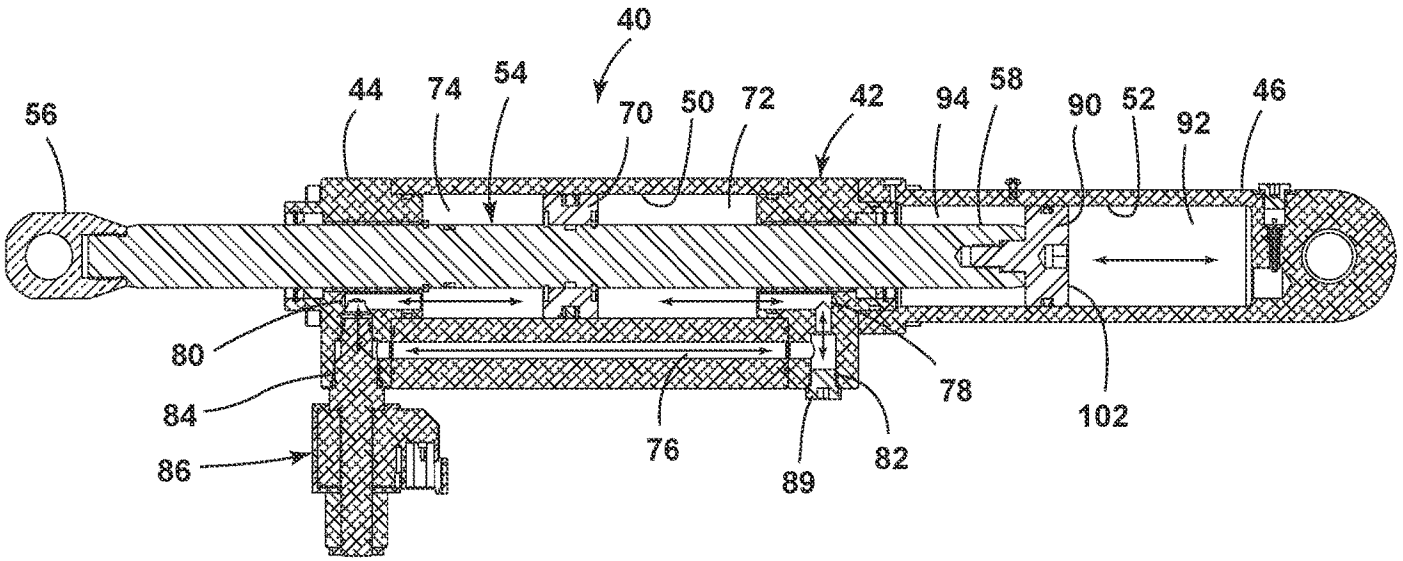
FIG. 10 is a cross-sectional view of the cylinder assembly taken along the line X-X.
Figure 11:
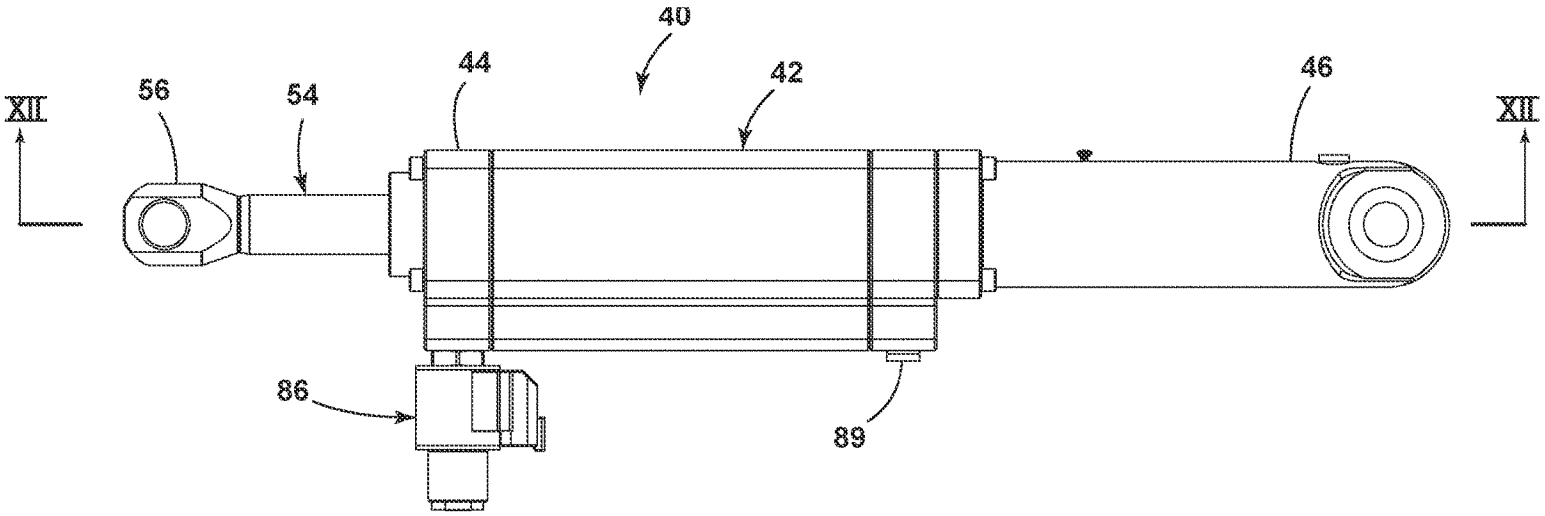
FIG. 11 is a top plan view of the cylinder assembly.
Figure 12:
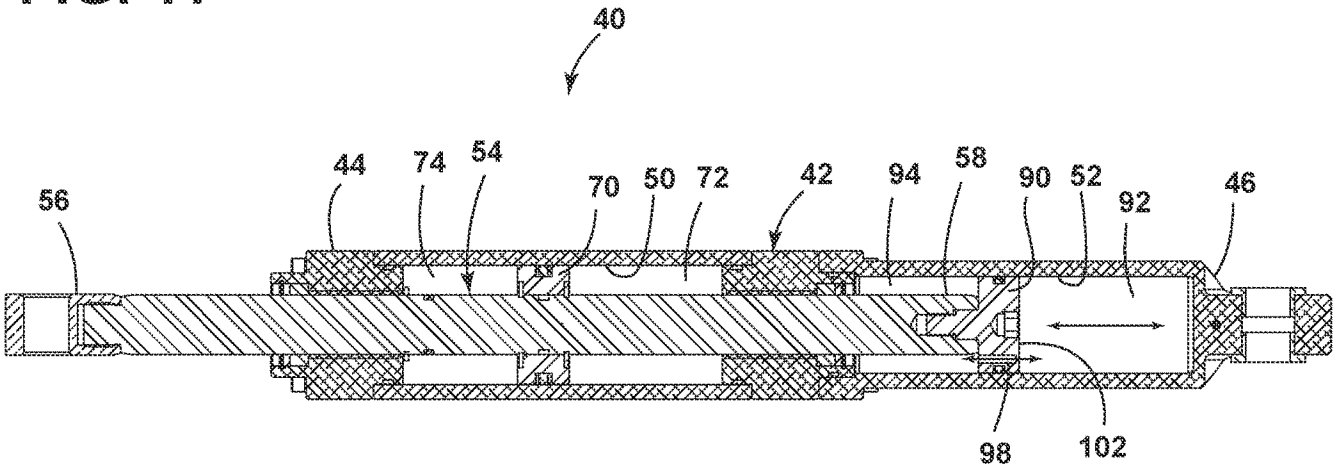
FIG. 12 is a cross-sectional view of the cylinder assembly taken along the line at XII-XII, FIG. 11.

As best illustrated in FIGS. 5 and 6, the wakeboard tower assembly 10 further includes a cylinder assembly 40 positioned within the interior space 34 of the housing 26 of each of the base assemblies 14. Each cylinder assembly 40 (FIGS. 7-10) may include a cylinder or housing 42 that includes a first end 44, and a second end 46, where the second end 46 is pivotably coupled to the base assembly 14 at a pivot point 48. Each cylinder or housing 42 defines a first chamber 50 and a second chamber 52, as further described below. Each cylinder assembly 40 further includes a shaft 54 telescopingly received within the first and second chambers 50, 52 such that the shaft 54 extends through the first end 44 of the cylinder 42. The shaft 54 is movable within the cylinder 42 between a retracted position C (FIGS. 5 and 7) and an extended position D (FIGS. 6 and 8), where the cylinder assembly 40 has a greater overall effective length when in the extended position D as compared to the retracted position C. The shaft 54 includes a first end 56 that is pivotably coupled to one of the arms 16 at a pivot point 60.

Each cylinder assembly 40 further includes a first piston 70 fixed to the shaft 54 along a length of the shaft 54, where the first piston 70 cooperates with the cylinder assembly 40 to divide the first chamber 50 into a first portion 72 and a second portion 74. The cylinder assembly 40 further includes a return passage 76 extending between and providing fluid communication between the first portion 72 and the second portion 74 of the first chamber 50 via ports 78, 80, respectively. In the illustrated example, the cylinder or housing 42 is a single, one-piece integral member that includes both the first chamber 50 and the return passage 76. In the illustrated example, access ports 82, 84 are provided at opposite ends of the cylinder 42 such that the access ports 82, 84 are in fluid communication with the ports 78, 80, respectively.

Each cylinder assembly 40 further includes a controllable valve such as a solenoid valve 86 received within one of the access ports 82, 84, and that may be operated by an operator between a first or closed position (FIG. 10) where the solenoid valve 86 prevents fluid from traveling through the return passage 76, thereby preventing fluid from traveling between the first portion 72 and the second portion 74 of the first chamber 50, and an open or second position where the solenoid valve 86 allows fluid to travel between the first portion 72 and the second portion 74 of the first chamber 50 via the return passage 76, and as further described below. The first portion 72 and the second portion 74 of the first chamber 50 and the return passage 76 cooperate to form a closed-loop fluid circuit. It is noted that the valve 86 may be positioned within either of the access ports 82, 84, with FIGS. 5 and 6 showing the valve 86 within the access port 82 and FIGS. 7-12 showing the valve within the access port 84, and a threaded plug 89 received in the opposite access port 82, 84. Each cylinder assembly 40 further includes a second piston 90 fixed to the second end 46 of the associated shaft 54, where the second piston 90 cooperates with the cylinder 42 to divide the second chamber 52 into a first portion 92 and a second portion 94. In the illustrated example, the second piston 96 includes a port 98 extending through the piston 96 and providing fluid communication between the first portion 92 and the second portion 94 of the second chamber 52. The second chamber 52 is configured to receive a pressurized gas such as nitrogen therein, so as to assist an operator with moving the towing assembly 12 from the lowered storage position A to the raised in-use position B, as described below.

In operation, the solenoid valve 86 may be positioned in the closed or first position (FIG. 10) so as to prevent fluid from traveling between the first portion 72 and the second portion 74 of the first chamber 50 via the return passage 76, thereby preventing the shaft 84 from moving between the retracted and extended positions C, D, and as a result, locking the towing assembly 12 at a preselected height and preventing the tower assembly 12 from moving between the lowered storage and raised in-use positions A, B. An operator may adjust the position of the towing assembly 12 from the lowered storage position A to the raised in-use position B by applying an upwardly-directed vertical force $F_1$ to a portion of the towing assembly 12 and then activating the solenoid valve 86 either mechanically or via an electrical signal from a remote located operator switch, thereby moving the solenoid valve 86 from the closed position to the open position and allowing fluid to flow between the second portion 74 and the first portion 72 of the first chamber 50 via the return passage 76. Once the towing assembly 12 has been repositioned to a desired vertical position from the lowered storage position A toward the raised in-use position B, the operator may release or move the solenoid valve 86 from the open position to the closed position, where the solenoid valve 86 prevents movement of the fluid between the first portion 72 and the second portion 74 of the first chamber 50 via the return passage 76, thereby preventing the shaft 54 from moving with respect to the cylinder 72 and preventing the cylinder assembly 40 from moving between the retracted position C and the extended position D, and as a result, locking the towing assembly 12 at the selected vertical position. The towing assembly 12 may be lowered from the raised in-use position B to the lowered storage position A by applying a lesser force $F_2$ to the portion of the towing assembly 12, and releasing the valve 86 in a similar manner to that discussed above.

As best illustrated in FIGS. 9-12, the pressurized gas located within the second chamber 52 serves to assist the operator in moving the towing assembly 12 from the lowered storage position A toward the raised in-use position B by supplementing the force $F_1$ exerted by the user, as well as supplementing the force $F_2$ as the operator moves the towing assembly 12 from the raised in-use position B toward the lowered storage position A. Specifically, the pressurized gas located within the first portion 92 of the second chamber 82 exerts a force on the surface of the second piston 96 exposed to the first portion 92 of the second chamber 52, thereby forcing or biasing the shaft 54 from the retracted position C toward the extended position D, thereby in turn exerting a force or biasing the towing assembly 12 from the lowered storage position A toward the raised in-use position B, and lessening or decreasing the amount of force that must be exerted by the user in order to reposition or move the towing assembly 12 from the lowered storage position A toward the raised in-use position B. It is noted that the overall volume of the second chamber 52 available to receive the gas located therein is reduced as the shaft 54 moves from the extended position D toward the retracted position C due to the shaft 54 filling a greater amount of the volume of the second chamber 52 as the shaft 54 is extended further and further therein. As a result, the gas pressure within the second chamber 52 increases as the shaft 54 is moved from the extended position D toward the retracted position C, thereby resulting in a greater force being exerted by the gas on the surface 102 of the second piston 90 and increasing the biasing force or supplemental force provided by the gas to assist the operator in moving the towing assembly 12 from the lowered storage position A toward the raised in-use position B. Preferably, the gas located within the second chamber 52 comprises nitrogen, although other suitable gasses may be utilized depending upon the application. Also preferably, the gas pressure within the second chamber 52 is between about 5 psi and about 2000 psi when the shaft 54 is in the retracted position C, and between about 5 psi and about 2000 psi when the shaft 54 is in the extended position D, and more preferably the gas pressure in the second chamber 52 is about 1200 psi when the shaft 54 is in the retracted position C and about 800 psi when the shaft 54 is in the extended position D.

The present inventive adjustable wakeboard tower assembly provides a towing arrangement that is easy to operate and adjust between selected vertical positions, increases safety during operation, is efficient in use, is capable of a long operating life, and is particularly well adapted for the proposed use.

The invention claimed is:

1. A wakeboard tower assembly, comprising:

a towing assembly configured to support a tow rope for towing a user behind a watercraft;

a base assembly operably supporting the towing assembly between a lowered storage position and a raised in-use position; and at least one cylinder assembly configured to bias the towing assembly from the lowered storage position toward the raised in-use position, the at least one cylinder assembly comprising:

a cylinder including a first chamber configured to receive a fluid and a second chamber separated from the first chamber and configured to receive a pressurized gas;

a shaft telescopingly received within the cylinder between a retracted position corresponding to the lowered storage position of the towing assembly and an extended position corresponding to the raised in-use position of the towing assembly;

a first piston fixed to the shaft and configured to cooperate with the cylinder to divide the first chamber into a first portion of the first chamber and a second portion of the first chamber;

a second piston fixed to the shaft and configured to cooperate with the cylinder to divide the second chamber into a first portion of the second chamber and a second portion of the second chamber, wherein the second piston includes a port providing fluid communication between the first and second portions of the second chamber, and wherein the pressurized gas biases the shaft from the retracted position toward the extended position;

a return passage configured to provide fluid communication between the first and second portion of the first chamber, wherein the first chamber and the return passage cooperate to form a closed loop; and a controllable valve operable between a closed position that prevents fluid flow through the return passage and fluid communication between the first and second chambers of the first chamber thereby preventing the shaft from moving between the retracted and extended positions and the towing assembly from moving between the lowered storage and raised in-use positions, and an open position that allows fluid flow through the return passage and fluid communication between the first and second portions of the first chamber thereby allowing the shaft to move between the retracted and extended positions and the towing assembly to move between the lowered storage and raised in-use positions.

2. The wakeboard tower assembly of claim 1, wherein the controllable valve includes a solenoid valve.

3. The wakeboard tower assembly of claim 1, wherein the return passage is integral with the cylinder.

4. The wakeboard tower assembly of claim 1, wherein a gas pressure in the second chamber is between about 5 psi and about 2000 psi when the shaft is in the retracted position, and between about 5 psi and about 2000 psi when the shaft is in the extended position.

5. The wakeboard tower assembly of claim 4, wherein the gas pressure in the second chamber is about 1200 psi when the shaft is in the retracted position, and 800 psi when the shaft is in the extended position.

6. The wakeboard tower assembly of claim 1, wherein the pressurized gas comprises nitrogen.

7. The wakeboard tower assembly of claim 1, wherein the towing assembly is pivotably coupled to the based assembly.

8. The wakeboard tower assembly of claim 1, wherein the towing assembly includes a pair of arms extending upwardly from the base assembly, and a cross member extending horizontally between the pair of arms.

9. The wakeboard tower assembly of claim 1, wherein the tower assembly may be locked by the at least one cylinder assembly at any position between the lowered storage and raised in-use positions.

10. The wakeboard tower assembly of claim 1, wherein an amount of the gas within the second chamber remains constant as the shaft is moved from the extended position to the retracted position.

11. The wakeboard tower assembly of claim 1, wherein the at least one cylinder assembly includes a pair of cylinder assemblies.

12. A wakeboard tower assembly, comprising:

a towing assembly including a pair of vertically extending arms and a cross member extending horizontally between the pair of arms and configured to support a tow rope for towing a user behind a watercraft;

a base assembly pivotably supporting the towing assembly between a lowered storage position and a raised in-use position; and a pair of cylinder assemblies each configured to bias the towing assembly from the lowered storage position toward the raised in-use position, each cylinder assembly comprising:

a cylinder including a first chamber configured to receive a fluid and a second chamber separated from the first chamber and configured to receive a pressurized gas;

a shaft telescopingly received within the cylinder between a retracted position corresponding to the lowered storage position of the towing assembly and an extended position corresponding to the raised in-use position of the towing assembly;

a first piston fixed to the shaft and configured to cooperate with the cylinder to divide the first chamber into a first portion of the first chamber and a second portion of the first chamber;

a second piston fixed to the shaft and configured to cooperate with the cylinder to divide the second chamber into a first portion of the second chamber and a second portion of the second chamber, wherein the second piston includes a port providing fluid communication between the first and second portions of the second chamber, and wherein the pressurized gas biases the shaft from the retracted position toward the extended position;

a return passage configured to provide fluid communication between the first and second portion of the first chamber, wherein the first chamber and the return passage cooperate to form a closed loop; and a solenoid valve operable between a closed position that prevents fluid flow through the return passage and fluid communication between the first and second chambers of the first chamber thereby preventing the shaft from moving between the retracted and extended positions and the towing assembly from moving between the lowered storage and raised in-use positions, and an open position that allows fluid flow through the return passage and fluid communication between the first and second portions of the first chamber thereby allowing the shaft to move between the retracted and extended positions and the towing assembly to move between the lowered storage and raised in-use positions.

13. The wakeboard tower assembly of claim 12, wherein the return passage is integral with the cylinder.

14. The wakeboard tower assembly of claim 12, wherein a gas pressure in the second chamber is between about 5 psi and about 2000 psi when the shaft is in the retracted position, and between about 5 psi and about 2000 psi when the shaft is in the extended position.

15. The wakeboard tower assembly of claim 14, wherein the gas pressure in the second chamber is about 1200 psi when the shaft is in the retracted position, and 800 psi when the shaft is in the extended position.

16. The wakeboard tower assembly of claim 12, wherein the pressurized gas comprises nitrogen.

17. The wakeboard tower assembly of claim 12, wherein the tower assembly may be locked by the at least one cylinder assembly at any position between the lowered storage and raised in-use positions.

18. The wakeboard tower assembly of claim 12, wherein an amount of the gas within the second chamber remains constant as the shaft is moved from the extended position to the retracted position.

19. A method of operating a wakeboard tower assembly, comprising:

providing a towing assembly configured to support a tow rope for towing a user behind a watercraft;

providing a base assembly operably supporting the towing assembly between a lowered storage position and a raised in-use position;

providing at least one cylinder assembly configured to bias the towing assembly from the lowered storage position toward the raised in-use position, the at least one cylinder assembly comprising:

a cylinder including a first chamber configured to receive a fluid and a second chamber separated from the first chamber and configured to receive a pressurized gas;

a shaft telescopingly received within the cylinder between a retracted position corresponding to the lowered storage position of the towing assembly and an extended position corresponding to the raised in-use position of the towing assembly;

a first piston fixed to the shaft and configured to cooperate with the cylinder to divide the first chamber into a first portion of the first chamber and a second portion of the first chamber;

a second piston fixed to the shaft and configured to cooperate with the cylinder to divide the second chamber into a first portion of the second chamber and a second portion of the second chamber, wherein the second piston includes a port providing fluid communication between the first and second portions of the second chamber, and wherein the pressurized gas biases the shaft from the retracted position toward the extended position;

a return passage configured to provide fluid communication between the first and second portion of the first chamber, wherein the first chamber and the return passage cooperate to form a closed loop; and a controllable valve operable between a closed position that prevents fluid flow through the return passage and fluid communication between the first and second chambers of the first chamber thereby preventing the shaft from moving between the retracted and extended positions and the towing assembly from moving between the lowered storage and raised in-use positions, and an open position that allows fluid flow through the return passage and fluid communication between the first and second portions of the first chamber thereby allowing the shaft to move between the retracted and extended positions and the towing assembly to move between the lowered storage and raised in-use positions; and repositioning the towing assembly from the lowered storage position to the raised in-use position by operating the controllable valve from the closed to the open, applying a upwardly directed force to towing assembly, moving the towing assembly from the lowered storage position to the raised in-use position, and operating the controllable valve from the open position to the closed position.

20. The method of claim 19, wherein the controllable valve includes a solenoid valve.

21. The method of claim 19, wherein the return passage is integral with the cylinder.

22. The method of claim 19, wherein a gas pressure in the second chamber is between about 5 psi and about 2000 psi when the shaft is in the retracted position, and between about 5 psi and about 2000 psi when the shaft is in the extended position.

23. The method of claim 22, wherein the gas pressure in the second chamber is about 1200 psi when the shaft is in the retracted position, and 800 psi when the shaft is in the extended position.

24. The method of claim 19, wherein the pressurized gas comprises nitrogen.

25. The method of claim 19, wherein the towing assembly is pivotably coupled to the based assembly.

26. The method of claim 19, wherein the towing assembly includes a pair of arms extending upwardly from the base assembly, and a cross member extending horizontally between the pair of arms.

27. The method of claim 19, wherein the tower assembly may be locked by the at least one cylinder assembly at any position between the lowered storage and raised in-use positions.

28. The method of claim 19, wherein an amount of the gas within the second chamber remains constant as the shaft is moved from the extended position to the retracted position.

29. The method of claim 19, wherein the at least one cylinder assembly includes a pair of cylinder assemblies.

* * * * *